US005642967A

United States Patent [19]

Swain et al.

[11] Patent Number: 5,642,967

[45] Date of Patent: Jul. 1, 1997

[54] CRAWL SPACE MOISTURE CONTROL METHOD

[76] Inventors: Kenneth L. Swain, 701 Park Ave., Greenwood, Ind. 46143; Greg B. Key, 5106 Shelby St., Indianapolis, Ind. 46227

[21] Appl. No.: 528,346

[22] Filed: Sep. 14, 1995

[51] Int. Cl.[6] ..... F02B 11/00

[52] U.S. Cl. ..... 405/229; 52/169.5

[58] Field of Search ..... 405/229; 52/169.5, 52/302.1, 302.3

[56] References Cited

U.S. PATENT DOCUMENTS

| | | | |
|---|---|---|---|
| 3,426,487 | 2/1969 | Forte | 52/169.5 X |
| 3,562,982 | 2/1971 | Parezo | 52/169.5 |
| 3,852,925 | 12/1974 | Gazzo | 52/169 |
| 3,990,469 | 11/1976 | Ralston | 137/362 |
| 4,253,285 | 3/1981 | Enright | 52/169 |
| 4,486,986 | 12/1984 | Cosenza | 52/169.5 |
| 4,523,875 | 6/1985 | DiFiore | 405/50 |
| 4,612,742 | 9/1986 | Bevilacqua | 52/169 |
| 4,869,032 | 9/1989 | Geske | 52/169 |
| 5,248,225 | 9/1993 | Rose | 405/229 |
| 5,495,696 | 3/1996 | Repka | 405/229 X |

*Primary Examiner*—William P. Neuder

*Attorney, Agent, or Firm*—Woodard, Emhardt, Naughton, Moriarty & McNett

[57] ABSTRACT

Method of reducing moisture damage to a building having a foundation crawl space with a floor that includes excavating a pit in the floor and positioning a plastic liner in the pit. This plastic liner defines a cavity and an inlet intersecting the cavity which is configured to collect water. A space exists between the liner and the pit. A trench is formed in a portion of the floor and configured to intersect the pit. A drain tile is put in the trench which has an outlet engaging the inlet of the liner. A pneumatic conveyor system is positioned outside the crawl space which has an intake and a dispensing outlet. An aggregate source is provided outside the crawl space adjacent the intake, and the aggregate generally does not exceed the size of pea gravel. A flexible hose is connected to the dispensing outlet which has a discharge outlet selectively positioned within the crawl space. Aggregate is drawn by suction into the intake and then discharged through the discharge outlet by pressurized air at a rate of at least three tons per hour. Aggregate is deposited on the floor of the crawl space including the trench and space surrounding the liner. A moisture barrier is placed on top of the floor and aggregate to reduce exposure of the building to moisture from the crawl space. A pump system is installed for pumping water out of the pit.

23 Claims, 2 Drawing Sheets

CRAWL SPACE MOISTURE CONTROL METHOD

BACKGROUND OF THE INVENTION

The present invention relates to methods and systems for reducing moisture damage to a building which has a crawl space in the foundation.

Many buildings, especially smaller homes, have a foundation with a crawl space. This crawl space provides access to utility connections and other structural features of the building for periodic servicing. In most cases, the majority of the crawl space is underground, and has a predominantly soil floor usually 18–24 inches in depth. However, gravel and other fill materials—including leftover construction materials and trash—are often found on or embedded in the crawl space floor. Occasionally, the crawl space floor may include a concrete slab.

Unfortunately, the ground water table is often high enough in poorly drained soils that at least a portion of the crawl space is below it. As a result, ground water is consistently present at some level within the crawl space causing an excessive moisture problem. These wet crawl spaces encourage mold and fungus growth which decays wood structure exposed to the moisture, such as floor joists and subflooring. In addition, unpleasant odors often result. Furthermore, when the problem is so severe that water stands in the crawl space, the situation may pose a health risk.

To address this problem, some builders install a moisture barrier, such as a sheet of thick plastic, over the floor of the crawl space. Although this moisture barrier can reduce exposure to moisture present in small amounts in well-drained soil, it does not provide for the removal of excessive water common to a truly "wet" crawl space. In fact, a vapor barrier without a removal system often intensifies the problem because water becomes trapped on top of it.

One way to solve this problem is by installing a drain tile in a trench, and connecting this trench to a sump pit system. This approach includes excavating a trench along the inner perimeter of the crawl space. This trench intersects the sump pit system and is configured to receive the drain tiles. The trench is back filled with an aggregate which surrounds the drain tiles. Commonly, the sump pit is surrounded by aggregate. The drain tiles collect water laterally from the crawl space floor and adjacent walls for drainage into the sump pit, and the porous nature of the surrounding aggregate displaces excess water for collection in the sump pit. The sump pit system may include a pump and connected conduit through which water is pumped away from the building when it exceeds a predetermined level within the pit. A similar system is shown in U.S. Pat. No. 3,562,982 52/169.5, 169.14, 302.3 to Parezo which is hereby incorporated by reference. Notably, this system does not remove all the water present in the crawl space nor does it eliminate the need for a moisture or vapor barrier. Instead, this system controllably removes excess water in the crawl space and keeps it under the vapor barrier so that the remainder of the building is not exposed to the troublesome excess moisture.

While this system is effective, it can often be costly to install once the building has been built. One aspect adding to the cost is the movement of the aggregate into the crawl space and the laborious task of arranging it therein. Specifically, because of the limited dimensions of a crawl space (a height of generally less than four feet) all the foundation vents are usually removed to install gravel shoots, and the gravel is moved within the crawl space to desired locations by hand shoveling or with a sled.

In cases were the moisture problem is not severe, a less complex drain system which does not use drain tiles may suffice. Even the excavation of a trench may not be needed in some cases. Unfortunately, these alternative systems require additional aggregate to perform correctly. The current labor intensive method of placing aggregate in the crawl space prevents these alternative systems from being cost effective. Consequently, what is needed is a way to reduce the cost of installing existing drain tile trench systems as well as a way to make alternative systems cost effective.

SUMMARY OF THE INVENTION

One aspect of the present invention is the pneumatic transport of aggregate for use in the correction of moisture problems in a crawl space. One preferred embodiment which implements this feature includes creating a pit in the floor of the crawl space for collecting water and pneumatically moving an aggregate through a conduit to a selected position within the crawl space. An aggregate bed is established on the floor using at least a portion of the aggregate which was pneumatically moved into the crawl space. The aggregate bed is configured to drain water into the pit for collection. This configuration may include a trench, or a trench with drain tile positioned therein. A moisture barrier is positioned over the aggregate bed and floor to reduce exposure of the building to moisture from the crawl space. Generally, this system keeps excess moisture under the barrier.

Another aspect of the present invention is the ability to cost effectively respond to the severity of the moisture problem by selecting the most appropriate moisture control system. In light to moderate cases, an aggregate bed over the surface area of the floor and a sump pit system is often adequate. One method of addressing more severe moisture problems is the addition of a trench in a portion of the crawl space floor which is configured to intersect the pit. This trench enhances collection and drainage of water to the pit. Aggregate is pneumatically deposited into the trench to displace excess water into the pit. In more severe cases a drain tile is positioned within the trench to further enhance collection and drainage of water. In the most severe cases, an aggregate bed is arranged over the entire surface area of the floor in addition to using a trench with drain tile. Generally, it is preferred to position a moisture or vapor barrier on top of the floor and aggregate to reduce exposure of the building to moisture from the crawl space regardless of the configuration selected.

Accordingly, one object of the present invention is to provide an improved method of moving aggregate to desired locations for use in a moisture control system for a crawl space.

Another object of the present invention is to provide a crawl space moisture control system which does not require formation of a trench.

Still another object of the present invention is to provide a crawl space drainage system which does not require drain tiles.

Further objects, features, and advantages of the present invention shall become apparent from the detailed drawings and descriptions which follow.

DESCRIPTION OF THE PREFERRED EMBODIMENT

Figure 1:
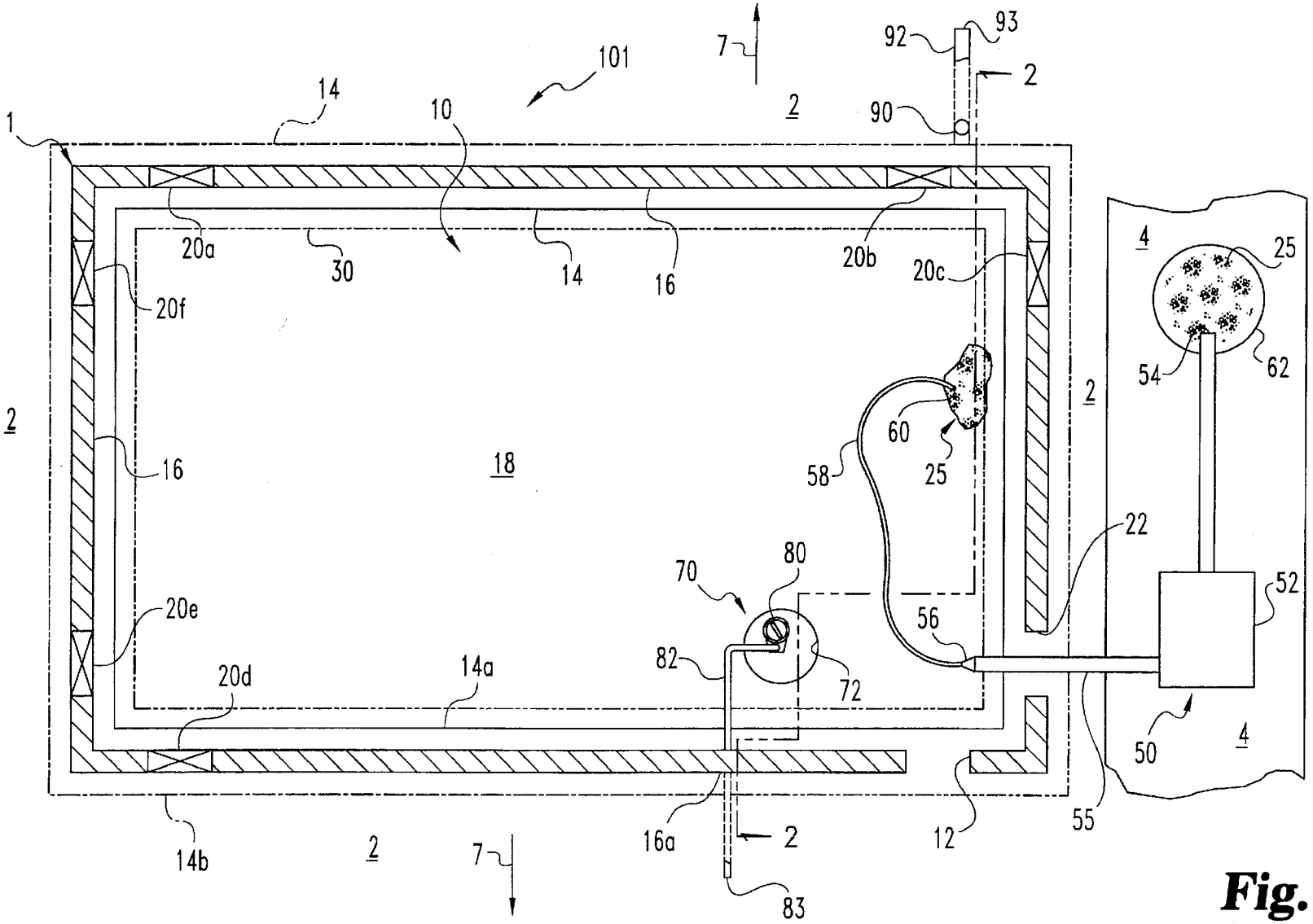
FIG. 1 is a schematic sectional top view of a building taken just above ground level with a pneumatic conveyor installed in the crawl space of the building in accordance with one preferred embodiment of the present invention. Various surroundings of the building are schematically depicted.

For the purposes of promoting an understanding of the principles of the invention, reference will now be made to the embodiment illustrated in the drawings and specific language will be used to describe the same. It will nevertheless be understood that no limitation of the scope of the invention is thereby intended, and that any alterations and modifications in the illustrated device, and further applications of the principles of the invention as illustrated therein are contemplated as would normally occur to one skilled in the art to which the invention relates.

The present invention relates to a system and associated method to control moisture in a crawl space. One aspect of the present invention is the use of a pneumatic conveyor to move aggregate from a source outside the crawl space to a desired location within the crawl space. Another aspect of the present invention is the ability to cost effectively respond to the severity of the moisture problem by selecting the most appropriate moisture control system. This selection can account for variables such as the relationship of the crawl space to the water table, soil conditions, geometry of the crawl space and foundation, geometry and composition of the ground surrounding the foundation, and relative cost of equipment and labor.

When this evaluation indicates a severe moisture problem, a drain tile system is generally indicated. In the most severe cases, a layer of aggregate is added to cover the entire floor of the crawl space in addition to the installation of a trench with drain tiles. When a problem of intermediate severity is detected, a trench system without drain tile is generally indicated. Similarly, in one variation of this system, a layer or bed of aggregate not only occupies the trench, but also covers a large portion of the surface area of the crawl space floor. When the problem is of a light to moderate concern, then an aggregate bed without a trench or drain tile often suffices. Naturally, many variations of these systems exist as would occur to those skilled in the art, given the factors associated with a particular crawl space. For all these systems, certain common preparations may be involved. One typical arrangement is depicted in FIG. 1.

FIG. 1 shows foundation 1 of a building 101 surrounded by ground surface 2 and adjacent driveway 4. Ground surface 2 is configured with a negative slope along a direction away from foundation 1 as indicated by arrows 7 so that water generally flows away from the building 101 and foundation 1. Foundation 1 includes footer 14 and perimeter walls 16. Typically, footer 14 is poured concrete and walls 16 comprise concrete block, but other configurations well known to those skilled in the art are also contemplated. The inner margin **14*a* of footer 14 is shown by a solid line within crawl space 10 indicating it is visible therein. In other preferred embodiments, footer 14 may be covered by dirt or other material inside crawl space 10. The corresponding outer margin 14*b* of footer 14** is shown in a broken line to indicate its underground position for the embodiment shown in FIG. 1.

Foundation 1 encloses and defines a crawl space 10 which has a dirt floor 18 and access opening 12. Walls 16 define vents **20*a*–20*f*. Wall portion 16*a* defines a passage for pipe 82 connected within crawl space 10 to pit system 70. Pit system 70 includes a pit 72 and sump pump 80 within crawl space 10. Also, passage 22 is illustrated where a vent has been removed to provide for access by a portion of pneumatic conveyor system 50**.

The crawl space moisture control system of the present invention includes the placement of aggregate 25 within crawl space 10. In the preferred embodiment, aggregate 25 generally includes at least some particles larger than sand. In a more preferred embodiment, the majority of aggregate 25 by weight consists of particles sized at least as large as pea sized gravel. In the most preferred embodiment, aggregate 25 is generally pea sized grave.

Pneumatic conveyor system 50 is for moving aggregate 25 from aggregate source 62 located outside foundation 1 to within crawl space 10. System 50 includes pneumatic conveyor 52 with an intake 54 configured to receive aggregate 25 from aggregate source 62, and dispensing tube 55 with dispensing outlet 56 configured to dispense aggregate 25 received through intake 54. In the preferred embodiment shown, dispensing outlet 56 is in fluid communication with discharge conduit 58. Discharge conduit 58 has discharge outlet 60 for dispensing aggregate within crawl space 10. Preferably, discharge conduit 58 is a flexible hose with a diameter of approximately 3 inches.

In one preferred embodiment, pneumatic conveyor 52 is powered by a diesel engine, and the pneumatic conveyor system 50 is mobile. For example, pneumatic conveyor system 50 is mounted to an over-the-road trailer which can be readily transported to a selected site having a moisture control problem and parked in an adjacent street or driveway. One preferred source of pneumatic conveyor 52 is the VACUTRANS system. Generally, the delivery rate of this system depends on the selected air pressure, the length and configuration of the discharge conduit, and the aggregate size. With a discharge conduit 58 of about 150 feet in length, the VACUTRANS system is capable of transferring at least 2 tons of pea size gravel per hour into crawl space 10.

FIG. 1 includes a trench line 30 in phantom along the inner perimeter of foundation 1 to indicate where a trench is preferably formed in floor 18 to facilitate implementation of some preferred embodiments of the present invention. For foundations having an internal wall within the crawl space, it may be advisable to excavate the trench under such wall or to create a passageway for the trench through the wall. Similarly, some unusually configured footers or crawl space floors including a concrete slab, may require reconfiguration of a portion of such structure as part of the moisture control process. These adjustments are assessed on a case-by-case basis and also depend on the severity of the moisture problem.

Figure 2:
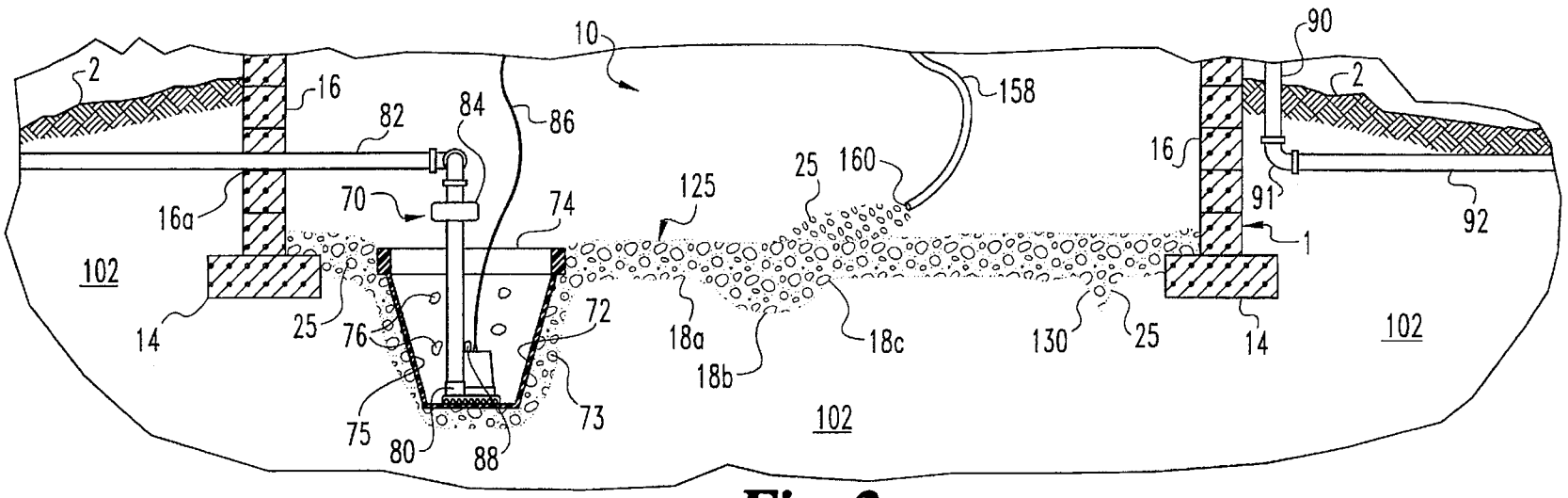
FIG. 2 is a schematic side view of a section taken of FIG. 1 illustrating installation of one preferred embodiment of the crawl space moisture control system with the pneumatic conveyor shown in a different position than in FIG. 1.

Referring to FIG. 2, as well as FIG. 1, pit system 70 includes a pit 72 which preferably is formed or excavated in a low lying portion of floor 18 near entrance 12 for ease of servicing. Also, pit system 70 includes a pump system with a sump pump 80 connected to conduit or pipe 82. Pipe 82 gradually emerges from underground portion 102 and eventually terminates at outlet 83 because of the negative grade of ground surface 2 as indicated by arrows 7. Pipe 82 includes a check valve 84 to prevent backflow of water into pit 72 through pipe 82. In other preferred configurations, pipe 82 may terminate underground in a dry well or sewer system.

In still another preferred embodiment, pipe 82 terminates in a bubbler system which is used when no negative slope exists or when the slope is very gradual. The bubbler system is positioned underground in a location remote to foundation 1. In this system, outlet 83 of pipe 82 intersects a T-shaped junction pipe in fluid communication therewith and having a lower limb directed generally downward into a well which is about 2–3 feet deep and about 8–10 inches in diameter. This well is filled with aggregate. Preferably, this lower limb is a 4 inch perforated tile that extends down into the hole and is also filled with aggregate. The T-shaped junction pipe also has an upper limb generally opposite the lower limb which terminates in a grate on the ground surface. This grate allows for overflow of water when the aggregate filled well cannot accommodate all the drainage. Essentially, this bubbler system is a small dry well that can accept 5–7 gallons of water for absorption by the ground in a fairly dry time, or in times of high water, can release excess water through the surface grate.

Pit 72 includes liner 74 which defines a cavity 75 therein. Liner 74 is generally configured in a bucket or barrel shape and is sized so that a space 73 is defined between pit 72 and the side of liner 74. In the preferred embodiment shown, pit 72 and liner 74 are configured so that space 73 extends between the bottom of pit 72 and the underside of liner 74. Aggregate 25 is shown filling space 73. Liner 74 is perforated with a plurality of holes 76 to facilitate drainage of excess water from surrounding aggregate 25. In one preferred embodiment, as many as 200 perforations are made, and liner 74 is made of a plastic material. In another preferred embodiment, pit system 70 does not include a liner. In still another preferred embodiment, the pit system 70 does not include a sump pump. Instead, for example, the pump system may use a pump external to pit 72 to remove excess water. In a variation of this embodiment, no pump system is used at all and pit 72 is configured to accept the excess water for absorption by the ground like a dry well.

The sump pump 80 of pit system 70 preferably has bladder switch 88 which is used to trigger activation of sump pump 80 when water within pit 72 exceeds a predetermined level. Also, for the preferred embodiment shown, power line 86 supplies electricity to an electric motor which drives sump pump 80.

Also depicted in FIGS. 1 and 2 is downspout 90, which is used, for example, to drain rain water from a gutter system (not shown). Downspout 90 is connected in fluid communication with conduit 92 by elbow 91. Notably, this connection occurs in the surrounding underground portion 102. Because of the negative grade of ground surface 2 as indicated by arrows 7, conduit 92 emerges from underground portion 102 and terminates at outlet 93. This arrangement directs water from downspout 90 away from the building and out outlet 93 to reduce accumulation of water around foundation 1 or in crawl space 10.

In one preferred embodiment, vents 20*a*–20*f* are modified or replaced as part of the moisture problem corrective action. Preferably, when replacement is required, temperature controlled vents are used which begin to open at approximately 40° Fahrenheit and become fully open at about 70° Fahrenheit. Correspondingly, these vents gradually close as the temperature cools. In one preferred embodiment, temperature controlled vents are positioned about 4 feet from the corners of the building to maximize moisture removal by cross ventilation.

FIG. 2 illustrates one preferred embodiment that employs trench 130 along trench line 30. Trench 130 is configured to intersect pit 72. This configuration is designed to correct a crawl space moisture problem of intermediate severity. As such, drain tiles are not required within trench 130. Instead, in this embodiment, aggregate 25 is dispensed through discharge outlet 160 and is arranged in a generally uniform aggregate bed 125 over crawl space floor 18. Aggregate bed 125 also occupies trench 130. Aggregate bed 125 also includes aggregate 25 surrounding liner 74 in pit 72. Preferably, bed 125 is leveled so that high points in the floor such as 18*a* and low points 18*b* are uniformly covered to provide an even surface on top of aggregate bed 125. Aggregate bed 125 provides a way to displace excess water contained in the crawl space to trench 130 and into pit 72. In one preferred embodiment, the average thickness of aggregate bed 125 along floor 18 is about 2 to 3 inches exclusive of that portion of the aggregate bed occupying trench 130 and pit 72.

In the preferred embodiment shown, trench 130 is formed with a V-shaped cross-section. Preferably this V-shaped trench has a depth of about 6 to 7 inches and a width at the level of floor 18 of about 3 to 4 inches. Notably, the excavation required to form a V-trench of these dimensions is somewhat less laborious than the usual drain tile trench. However, other preferred embodiments may vary the trench shape as would occur to one skilled in the art. In one preferred embodiment, an expanded nylon geotextile fabric insert is used in trench 130.

Figure 3:
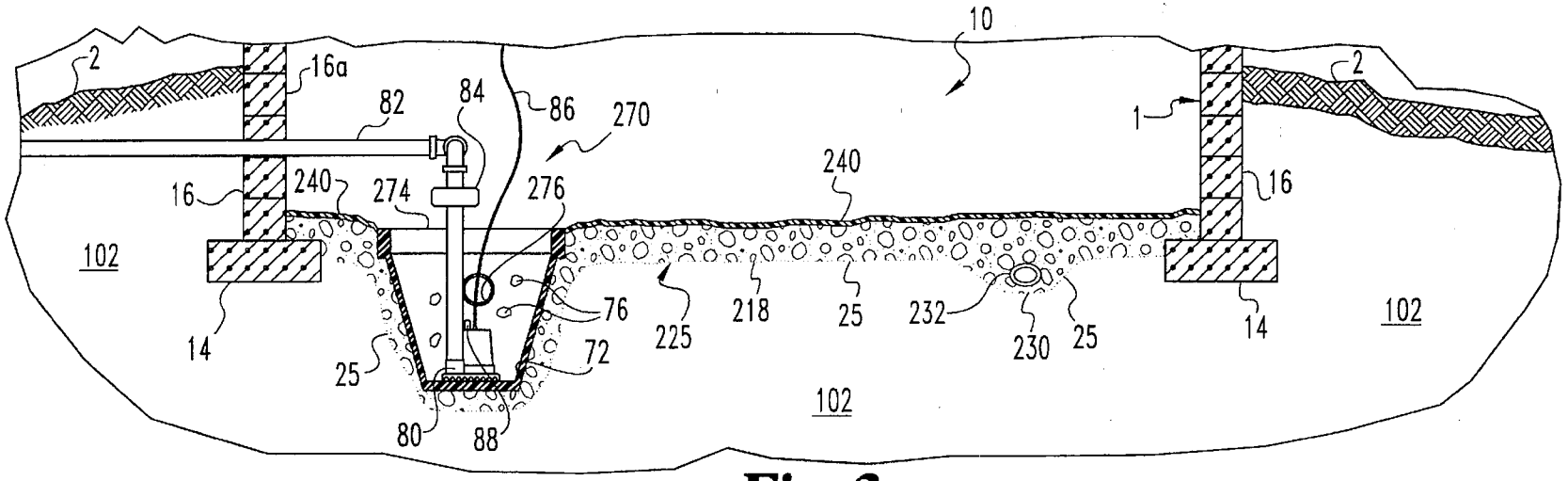
FIG. 3 is a schematic side sectional view of a crawl space similar to FIG. 2 illustrating an alternative preferred embodiment of the present invention.

Once all the aggregate 25 is dispensed and arranged to form aggregate bed 125 for the "tileless" trench system shown in FIG. 2, a vapor barrier is installed on top of aggregate bed 125 like vapor barrier 240 illustrated for another preferred embodiment of the crawl space moisture control system shown in FIG. 3. Preferably barrier 240 is a heavy gauge flexible plastic sheet.

Referring specifically to FIG. 3, an alternative embodiment of the present invention is illustrated for a most severe crawl space moisture control problem. In this preferred embodiment, pit system 270 is arranged the same as pit system 70 shown in FIGS. 1 and 2 with like structure being identically numbered. Notably, liner 274 of pit system 270 includes an inlet 276 configured for engagement of drain tiles 232. Preferably, these drain tiles are about 4 inches in diameter. Drain tiles 232 provide for more rapid drainage of excess water to pit system 270 and generally permit a greater quantity of water to be removed from crawl space 10 compared to the "tileless" system illustrated in FIG. 2.

Drain tiles 232 are positioned along trench 230 and empty into pit system 270 through inlet 276. In one preferred embodiment, trench 230 is formed along trench line 30 (see in FIG. 1.), and is about 8 to 10 inches deep, and about 1 foot wide at the top. In this embodiment, drain tiles 232 are positioned about 2 to 3 inches below the top of footer 14. This depth provides adequate drainage and yet does not incur the added expense of placing the tile deeper. Generally, the water table within the crawl space follows the depth of the drain tile in the trench. Notably, if the drain tile is lower than necessary, water is pumped at a higher rate generating more expense and more wear on the system.

The system shown in FIG. 3 includes an additional bed of aggregate 225 which extends across floor 218 to improve drainage. Aggregate bed 225 also occupies trench 230 and surrounds liner 274 in pit 72. Aggregate bed 225 displaces excess water and drains it into trench 230, drain tiles 232, and ultimately into pit system 270. In one preferred embodiment, the average thickness of the aggregate bed 225 along the floor is about 1 inch exclusive of that portion of aggregate bed 225 occupying trench 230 and pit 72. Preferably, aggregate bed 225 is arranged to provide a generally even surface for coverage by vapor barrier 240.

In another preferred embodiment of the present invention for correcting crawl space moisture control problems of light to moderate severity, a pit system like that shown in FIG. 2 is employed, but no trench is formed nor drain tiles installed. Instead, this preferred embodiment employs an aggregate bed which covers the crawl space floor to drain excess water to the pit system for removal. The thickness of this bed averages about 2 to 5 inches. In one preferred variation of this embodiment, the bed is arranged so that the floor has a generally level top surface for coverage by a moisture barrier.

Having described various preferred embodiments of the present invention, the operation of the associated moisture control processes is next discussed. One preferred method of controlling moisture in a crawl space in accordance with the present invention begins by evaluating the severity of the moisture control problem. This step requires inspection of the crawl space to determine its condition and accounts for all relevant factors and variables. One outcome of this evaluation is determining a target configuration for the moisture control system to be installed. Generally, any of the previously described systems could be used or any combination of the various elements disclosed as would occur to one skilled in the art. Next, the installation of the moisture control system is initiated.

Referring back to FIG. 1, the installation process may include removal of trash and debris from crawl space 10 and the repair of any damaged building structure. Also, if the structure requires reconfiguration, then such modifications may be performed. If it is determined that a trench is required, as might be the case for an intermediate to severe problem, it should be formed along an appropriate path. Often, electric shovels or hammers are used to perform reconfiguration and excavation steps. Similarly, if it is determined drain tiles are required, as might be the case for a severe problem, then they should be installed. Generally, a pit system 70 will be installed with an appropriate pump system. Also, aggregate 25 will need to be employed within crawl space 10. Preferably, moving and dispensing aggregate 25 is accomplished with pneumatic conveyor system 50.

When pneumatic conveyor system 50 is used, it must be positioned along with aggregate source 62 in an appropriate location outside crawl space 10. This placement may involve removal of a vent or other structure to provide for passage of pneumatic conveyor system 50 into crawl space 10 to facilitate movement and dispensing of aggregate 25, but removal of all the vents 20*a*–20*f* is not required. Intake 54 of pneumatic conveyor system 50 draws aggregate 25 from aggregate source 62 by suction. This aggregate is then conveyed through pneumatic conveyor 52. The aggregate is then propelled through dispensing outlet 56 into discharge conduit 58 and out discharge outlet 60 by pressurized air for selected placement within crawl space 10.

In one preferred embodiment, aggregate source 62 is a gravel pile supplied adjacent pneumatic conveyor 52. In an alternative preferred embodiment, the gravel is supplied in a hopper configured for access by intake 54 of pneumatic conveyor 52. In another preferred embodiment, the aggregate hopper is affixed to pneumatic conveyor 52 so that gravel is carried along with the conveyor 52 and the aggregate is fed by gravity into the conveyor device.

Aggregate 25, once located within crawl space 10 is then arranged as required for the specific moisture control system desired. This arrangement may include establishing an aggregate bed such as bed 125, 225 shown in FIGS. 2 and 3, respectively, or any variation as would occur to one skilled in the art. This bed may be deposited in a trench, around a drain tile, or surround a pit system liner as appropriate. The aggregate bed is arranged or configured to facilitate drainage of excess water in the crawl space to the pit system 70 including water surrounding crawl space 10 and water that seeps through walls 16 and around footer 14.

Preferably, a moisture barrier is installed over the floor and aggregate to prevent exposure of the building. Moisture is kept beneath the barrier by displacing water through the porous aggregate bed for collection in pit system 70. As the water level rises in pit system 70, the pump 80 is activated so that water is controllably pumped through pipe 82 away from the building and foundation 1.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of reducing moisture damage to a building having a foundation crawl space with a floor, comprising the steps of:

(1) forming a pit in the floor for collecting water in the crawl space;

(2) pneumatically moving an aggregate to a selected position within the crawl space;

(3) establishing an aggregate bed on the floor using at least a portion of the aggregate moved in step (2);

(4) configuring the aggregate bed to drain water into the pit for collection; and (5) positioning a moisture barrier over the aggregate bed and floor to reduce exposure of the building to moisture from the crawl space.

2. The method of claim 1 further comprising the steps of:

(6) positioning a liner in the pit, the liner being configured to define a cavity for collecting water, the liner being sized to define a space between the liner and the pit; and (7) depositing aggregate into the space.

3. The method of claim 2, further comprising the steps of:

(8) installing a pump system for pumping water out of the cavity and away from the crawl space; and (9) controlling moisture by pumping water out of the cavity with the pump system when water in the cavity exceeds a predetermined level.

4. The method of claim 1, wherein the aggregate is moved in step (2) at a rate of at least two tons per hour.

5. The method of claim 1, wherein a majority by weight of the aggregate moved in step (2) is at least the size of pea gravel.

6. The method of claim 1, further comprising the steps of:

(6) excavating a trench in a portion of floor, the trench being configured to intersect the pit; and (7) arranging the aggregate bed to occupy at least a portion of the trench.

7. The method of claim 6, further comprising the steps of:

(8) installing a plurality of temperature controlled vents; and (9) installing a conduit underground to divert water from a downspout away from the foundation.

8. The method of claim 6, further comprising the step of placing drain tile in the trench to facilitate drainage into the pit.

9. The method of claim 6, wherein a majority by weight of the aggregate moved in step (2) is at least the size of pea gravel, and further comprising the step of arranging the aggregate bed to fill the trench and cover at least a portion of the floor adjacent the trench.

10. The method of claim 9, wherein the aggregate bed covers approximately all of the floor surface area with an average thickness of at least 1 inch.

11. The method of claim 1, wherein step (2) includes the steps of:

(2a) positioning a pneumatic conveyor system outside the crawl space, the conveyor system having an intake to receive material and a conduit defining a discharge outlet for dispensing received material;

(2b) providing an aggregate source outside the crawl space adjacent the intake; and (2c) selectively positioning the discharge outlet within the crawl space in a desired location.

12. The method of claim 11, wherein step (2) further includes the steps of:

(2d) drawing aggregate into the intake from the aggregate source by suction when the conveyor system is activated; and (2e) discharging the aggregate through the conduit and out the discharge outlet at the desired location by pressurized air when the conveyor system is activated.

13. A method of reducing moisture damage to a building having a foundation crawl space with a floor, comprising the steps of:

(1) forming a pit in the floor for collecting water in the crawl space;

(2) forming a trench in a portion of the floor, the trench being configured to intersect the pit;

(3) pneumatically depositing an aggregate for placement in the trench to displace water into the pit, said depositing including:

(3a) positioning a pneumatic conveyor system outside the crawl space, the conveyor system having an intake to receive material and a conduit defining a discharge outlet for dispensing received material, (3b) providing an aggregate source outside the crawl space adjacent the intake, (3c) selectively positioning the discharge outlet adjacent the trench; and (4) positioning a moisture barrier on top of the floor and aggregate to reduce exposure of the building to moisture from the crawl space.

14. The method of claim 13, wherein step (3) further includes the steps of:

(3d) drawing aggregate into the intake from the aggregate source by suction when the conveyor is activated; and (3e) discharging the aggregate through the discharge outlet and into the trench by pressurized air when the conveyor system is activated.

15. The method of claim 13, further comprising the step of placing drain tile in the trench to facilitate drainage into the pit.

16. The method of claim 13, wherein a majority by weight of the aggregate moved in step (3) is at least the size of pea gravel, and further comprising the step of arranging the aggregate bed to fill the trench and cover at least a portion of the floor adjacent the trench.

17. The method of claim 13 further comprising the steps of:

(5) positioning a liner in the pit, the liner defining a cavity for collecting water, the liner being sized to define a space between the liner and the pit;

(6) depositing aggregate into the space;

(7) installing a pump system for pumping water out of the cavity and away from the crawl space; and (8) controlling moisture by pumping water out of the cavity with the pump system when water in the cavity exceeds a predetermined level.

18. The method of claim 13, wherein the aggregate is deposited in step (3) at a rate of at least two tons per hour.

19. A method of reducing moisture damage to a building having a foundation crawl space with a floor, comprising the steps of:

(1) excavating a pit in the floor;

(2) positioning a liner in the pit, the liner defining a cavity and an inlet intersecting the cavity, the cavity being configured to collect water, the liner being sized to define a space between the liner and the pit;

(3) forming a trench in a portion of the floor, the trench being configured to intersect the pit;

(4) putting a drain tile in the trench, the drain tile having an outlet engaging the inlet of the liner so that the water flowing along the drain tile is collected in the cavity;

(5) positioning a pneumatic conveyor system outside the crawl space, the conveyor system having an intake to receive material and a discharge outlet for dispensing received material;

(6) providing an aggregate source outside the crawl space adjacent the intake, the aggregate source providing an aggregate at least the size of pea gravel;

(7) selectively positioning the discharge outlet within the crawl space;

(8) drawing aggregate into the intake from the aggregate source by suction when the conveyor system is activated;

(9) discharging the aggregate through the discharge outlet at a rate of at least two tons per hour;

(10) depositing aggregate into the trench;

(11) depositing aggregate into the space;

(12) placing a moisture barrier on top of the floor and aggregate to reduce exposure of the building to moisture from the crawl space;

(13) installing a pump system for pumping water out of the cavity and away from the crawl space, the pump system including:

a submersible sump pump driven by an electric motor;

a conduit connected to the sump pump, the conduit having an outlet outside the building to expel water; and

(14) controlling moisture by pumping water out of the cavity with the pump system when water in the cavity exceeds a predetermined level.

20. A method of reducing moisture damage to a building having a foundation crawl space with a floor, comprising:

(a) forming a pit in the floor for collecting water in the crawl space;

(b) forming a trench in a portion of the floor, the trench being configured to intersect the pit;

(c) pneumatically depositing an aggregate for placement in the trench to displace water into the pit at a rate of at least two tons per hour; and (d) positioning a moisture barrier on top of the floor and aggregate to reduce exposure of the building to moisture from the crawl space.

21. The method of claim 20, further comprising placing drain tile in the trench to facilitate drainage into the pit.

22. The method of claim 20, wherein a majority by weight of the aggregate is at least the size of pea gravel, and further comprising arranging the aggregate bed to fill the trench and cover at least a portion of the floor adjacent the trench.

23. The method of claim 20, further comprising:

(e) positioning a liner in the pit, the liner defining a cavity for collecting water, the liner being sized to define a space between the liner and the pit;

(f) depositing aggregate into the space;

(g) installing a pump system for pumping water out of the cavity and away from the crawl space; and (h) controlling moisture by pumping water out of the cavity with the pump system when water in the cavity exceeds a predetermined level.

* * * * *